United States Patent [19]

Urakawa et al.

[11] Patent Number: 4,684,355

[45] Date of Patent: Aug. 4, 1987

[54] AUTOMOBILE HAVING SELECTIVE DRIVE WHEELS

[75] Inventors: Shigeki Urakawa, Tokyo; Noriyuki Inomata, Nagareyama, both of Japan

[73] Assignee: Takara Co., Ltd., Tokyo, Japan

[21] Appl. No.: 880,693

[22] Filed: Jul. 1, 1986

[51] Int. Cl.[4] ..... A63H 29/00

[52] U.S. Cl. ..... 446/464; 446/95; 446/457

[58] Field of Search ..... 446/95, 464, 457

[56] References Cited

U.S. PATENT DOCUMENTS 4,496,330 1/1985 Terui ..... 446/457 X 4,511,343 4/1985 Goldfarb et al. ..... 446/457 X

FOREIGN PATENT DOCUMENTS 2094165 9/1982 United Kingdom ..... 446/457

*Primary Examiner*—Kenneth Downey

*Attorney, Agent, or Firm*—Price, Gess & Ubell

[57] ABSTRACT

A toy automobile having selective drive wheels comprising a body, a chassis and pairs of front and rear wheels, in which either a front wheel windup spring drive unit or a freewheel holder along with a front axle is detachably arranged in a front space of the chassis, and in which either a rear wheel windup spring drive unit or a freewheel holder along with a rear axle is detachably arranged in a rear space of the chassis, whereby a selection between front wheel drive, rear wheel drive, four-wheel drive or four-freewheel is made possible.

14 Claims, 9 Drawing Figures

AUTOMOBILE HAVING SELECTIVE DRIVE WHEELS

BACKGROUND OF THE INVENTION

The present invention relates to a toy automobile having selective drive wheels.

In a conventional toy automobile, in general, rear wheels are driven by a windup spring drive unit disposed in a rear space of a body. This windup spring drive unit is comprised of a casing, a windup spring arranged in the casing, a plurality of gear wheels which are arranged in the casing and connected to the windup spring, and an output shaft to which the rear wheels are mounted. In this case, in order to change from rear wheel drive to front wheel drive, it seems that such a change can be easily conducted by reversing the direction and the mount position of the windup spring drive unit. However, in the toy automobile, since the height of the front space of the body is lower than that of the rear space of the body, the installation space of the drive unit in the front space is smaller than that in the rear space. Accordingly, by simply reversing the direction of the windup spring rear wheel drive unit and changing its mounting position from the rear space to the front space, the drive unit cannot be contained within the front space, nor can the front wheel axle be positioned in a proper site. In order to properly install the rear wheel drive unit in the front space of the body, it should be reduced in relation to the entire size of the toy automobile. If the windup spring drive unit is diminished, its drive force will be lessened and hence the operation of the toy automobile will be considerably less interesting.

SUMMARY OF THE INVENTION

Accordingly, it is an object of the present invention to provide a toy automobile having selective drive wheels, free from the aforementioned defects and disadvantages of the prior art, which is capable of readily selecting either front wheel drive, rear wheel drive, four-wheel drive or four-freewheel by means of a simple operation, and which because of this above capability, is very enjoyable to use.

In accordance with one embodiment of the invention, there is provided a toy automobile having selective drive wheels, comprising a body, a chassis having front and rear spaces, detachably mounted to the body, a pair of front wheels which are rotatably mounted to the chassis through either a front wheel windup spring drive unit or a first freewheel holder detachably arranged in the front space of the chassis, and a pair of rear wheels which are rotatably mounted to the chassis through either a rear wheel windup spring drive unit or a second freewheel holder of the same type as the first freewheel holder—detachably—arranged in the rear space of the chassis, whereby a selection between front wheel drive, rear wheel drive, four-wheel drive or four-freewheel is made possible.

Other and further objects, features and advantages of the invention will appear more fully from the following description taken in connection with the preferred embodiments thereof with reference to the accompanying drawings, in which: BRIEF DESCRIPTION OF THE DRAWINGS:

FIG. 1 is a perspective view of a toy automobile according to the present invention for explaining selective embodiments thereof;

FIG. 1*a* is toy automobile body;

FIG. 1*b* is a front wheel drive unit;

FIG. 1*c* is a rear wheel drive unit;

FIG. 2*a* is an elevated view of a front wheel drive unit;

FIG. 2*b* is an elevated view of a rear wheel drive unit;

FIG. 2*c* is an elevated view of a free wheel holder;

Figure 1A:
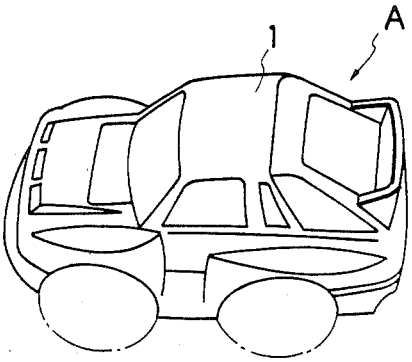
Figure 1B:
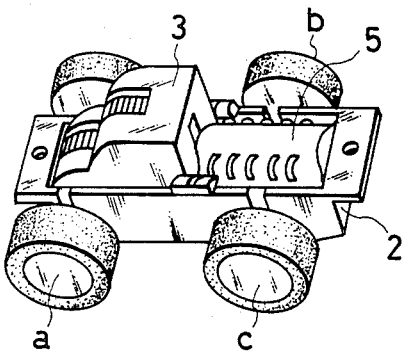
Figure 1C:
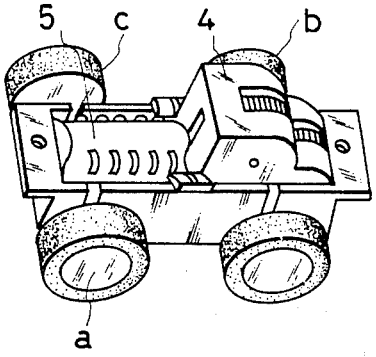
Figure 2A:
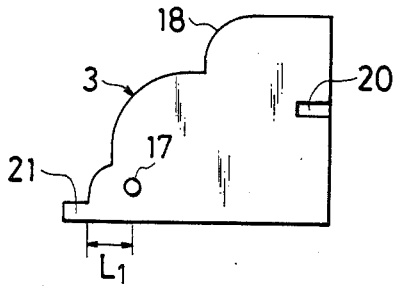
Figure 2B:
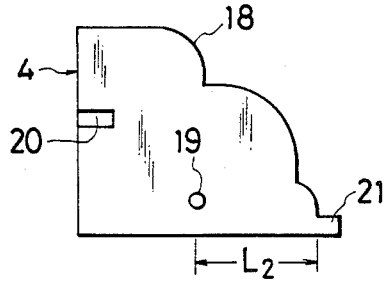
Figure 2C:
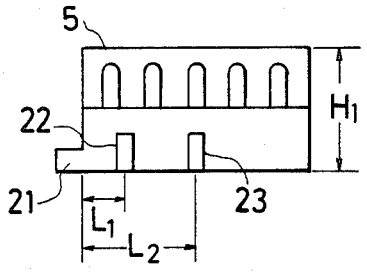
Figure 3:
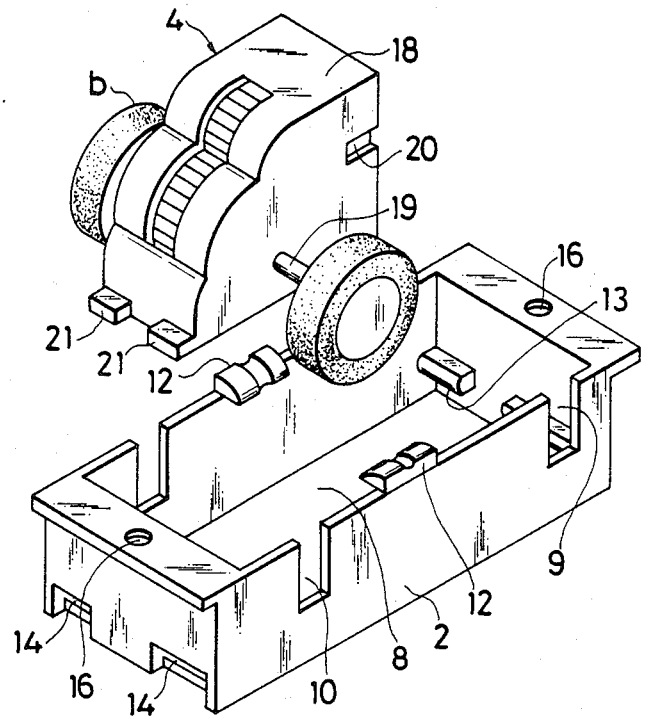
FIG. 3 is a perspective view of the rear wheel windup spring drive unit of FIG. 2 and a chassis of the toy automobile of FIG. 1.
Figure 4:
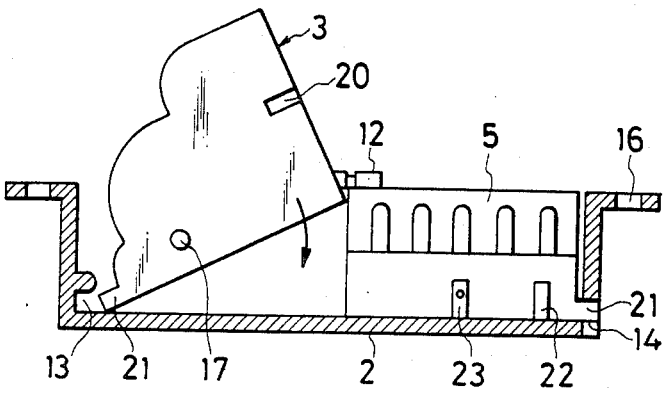
FIG. 4 is an elevational view, partly in section, of the front wheel windup spring drive unit and the freewheel holder shown in FIG. 2, for explaining the mounting of these two members onto the chassis shown in FIG. 1.

DESCRIPTION OF THE PREFERRED EMBODIMENTS:

Referring now to the drawings, wherein like reference numerals designate similar or corresponding components throughout the different figures and hence a description or the structure and function of such like components can be omitted for the sake of brevity, there is shown in FIGS. 1–5 a toy automobile having selective drive wheels according to the present invention.

In the drawings, the toy automobile A having selective drive wheels comprises a body 1, a chassis 2, a front wheel windup spring drive unit or a first drive unit 3, a rear wheel windup spring drive unit or a second drive unit 4 and a freewheel holder 5; any two of the members 3, 4 and 5 are selectively mounted to the chassis 2.

The chassis 2 is detachably mounted to the body 1 and is provided with a container portion 8 therein which is divided into a front half space and a rear half space. Either the first drive unit 3 for driving front wheels a or the freewheel holder 5 for retaining freewheels c is detachably arranged in the front half space, and either the rear drive unit 4 for driving rear wheels b or the freewheel holder 5 for retaining freewheels c is detachably arranged in the rear half space. The chassis 2 is further provided with pairs of slits 9 and 10 in the side walls of the front and rear portions of its container portion 8, through which the front and the rear wheel axles are inserted. The chassis 2 is also provided with engaging projections 12 in the upper inner middle portions of the side walls of the container portion 8, a pair of grooves 13 in the lower side portions of the front end wall of the container portion 8, a pair of slots 14 in the lower side portions of the rear end wall of the container portion 8, and front and rear holes 16 in the center portions of its front and rear end plate portions corresponding to female screw holes 15 formed in the front and the rear ends of the body 1.

The first windup spring drive unit 3 comprises a casing 18 having half the length of the container portion 8 of the chassis 2, the front upper portion of the casing 18 being gradually diminished so as to be reduced to a minimum; a combination of a windup spring (not shown) and a plurality of speed reduction gear wheels (not shown) connected thereto is included in the casing 18; and an output shaft 17 which projects sideways from the casing 18 in its lower front end portion and to which the front wheels a are secured. The casing 18 is provided with a pair of engaging grooves 20 in the middle rear end portions of its side faces, with which the engaging projections 12 of the container portion 8 of the chassis 2 are engaged, and a pair of front projections 21 in the lower side portions of its front end wall, which are inserted into the grooves 13 formed in the front end of the container portion 8 of the chassis 2. The distance $L_1$ between the front end and the output shaft 17 of the first drive unit 3 is approximately the same as the distance between the inlets of the grooves 13 and the front axle slits 9 of the container portion 8 of the chassis 2.

The second windup spring drive unit 4 has almost the same appearance as the first drive unit 3, except that an output shaft 19 projects sideways from its casing 18 in the lower middle portion and the rear wheels b are secured to the output shaft 19. In this case, the rear upper portion of the casing 18 is gradually diminished. The distance $L_2$ between the rear end and the output shaft 19 of the second drive unit 4 is approximately the same as the distance between the rear end wall and the rear axle slits 10 of the container portion 8 of the chassis 2. Since the front space in which the first drive unit 3 is arranged is narrower than the rear space in which the second drive unit 4 is arranged, the distance $L_2$ is longer than the distance $L_1$.

A conventional windup spring drive unit can be used for the second drive unit 4. However, since the casing 18 of the first drive unit 3 is symmetrically formed to the casing 18 of the second drive unit 4, the first drive unit 3 has one more gear wheel than the second drive unit 4.

The freewheel holder 5 having a form similar to an automobile engine is provided with pairs of front and rear axle holding slits 22 and 23 at distances $L_1$ and $L_2$ from its front end wall corresponding to the axle distances $L_1$ and $L_2$ from the front and the rear end walls of the first and the second drive units 3 and 4, and a pair of front projections 21 formed in the same manner as the front projections 21 of the first drive unit 3. The height $H_1$ of the freewheel holder 5 is substantially the same as that of the engaging projections 12 of the container portion 8 of the chassis 2.

Figure 5:
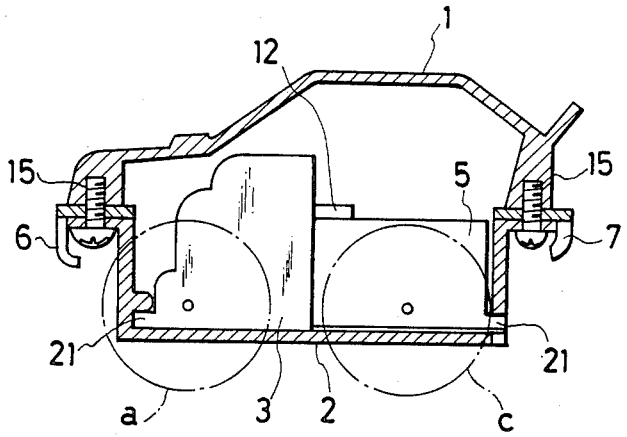
FIG. 5 is a longitudinal cross sectional view of the toy automobile, including the front wheel windup drive unit and the freewheel holder shown in FIG. 1.

A pair of front and rear bumpers 6 and 7, each having a hole in the central portion of its upper flat plate portion, are mounted between the body 1 and the chassis 2 in their front and rear ends by using screw bolts, as clearly shown in FIG. 5.

The front wheel drive toy automobile is assembled as follows. To begin with, the first drive unit 3 is disposed in the front half space of the container portion 8 of the chassis 2 by engaging the front projections 21 of the first drive unit 3 with the grooves 13 of the container portion 8 while the front axle or the output shaft 17 of the first drive unit 3 is fitted in the front slits 9 of the container portion 8 of the chassis 2. Then, a rear axle to which the rear wheels b are secured, is fitted in the rear slits 10 of the container portion 8, and the freewheel holder 5 is arranged in the rear half space of the container portion 8 by inserting the projections 21 of the freewheel holder 5 into the slots 14 of the container portion 8 of the chassis 2. On this occasion, the engaging projections 12 of the container portion 8 of the chassis 2 are engaged with the engaging grooves 20 of the first drive unit 3 and the upper rear side ends of the freewheel holder 5, thereby ensuring the mounting of these two members in the container portion 8 of the chassis 2. Then, the chassis 2 is mounted to the body 1 along with the front and the rear bumpers 6 and 7 by tightening the screw bolts inserted through the holes 16 of the chassis 2 via the holes of the front and the rear bumpers 6 and 7 into the screw holes 15 of the body 1.

Next, the rear wheel drive toy automobile is assembled as follows. The second drive unit 4 is arranged in the rear half space of the container portion 8 of the chassis 2 in a manner similar to the first drive unit 3, as described above, by inserting the projections 21 of the rear drive unit 4 into the slots 14 of the container portion 8 of the chassis 2, and then the freewheel holder 5 is mounted into the front half space of the container portion 8 in a manner similar to the freewheel holder 5 mounted in the container portion 8 of the front wheel drive toy automobile, as hereinbefore described, by inserting the projections 21 of the freewheel holder 5 into the grooves 13 of the container portion 8 of the chassis 2. Then, the chassis 2 is mounted to the body 1 along with the front and the rear bumpers 6 and 7, in the same manner as described above in the case of the front wheel drive toy automobile.

In these two examples, when the freewheel holder 5 is arranged in the rear half space of the container portion 8 of the chassis 2, the rear freewheel axle is fitted in the rear axle holding slits 23 of the freewheel holder 5, and, when the freewheel holder 5 is arranged in the front half space of the container portion 8, the front freewheel axle is fitted in the front axle holding slits 22 of the freewheel holder 5.

When the four-wheel drive toy automobile is assembled, the first and the second drive units 3 and 4 are arranged in the front and the rear half spaces of the container portion 8 of the chassis 2 in the same manner as the above described examples, and the chassis 2 and the body 1 are coupled together along with the front and the rear bumpers 6 and 7, also in the same manner as above.

When the four-freewheel toy automobile is assembled, two freewheel holders 5 are fitted in the front and the rear half spaces of the container portion 8 of the chassis 2, and then the chassis 2 is mounted to the body 1 along with the front and the rear bumpers 6 and 7, in the same manner as described above.

It is readily understood from the above description that a choice between either front wheel drive, rear wheel drive, four-wheel drive or four-freewheel is made possible in a toy automobile by either detachably mounting the first drive unit or a freewheel holder along with freewheels secured to a front axle into a front half space of a container portion of a chassis, or detachably mounting the second drive unit or the freewheel holder along with a rear axle to which freewheels are secured, into a rear half space of the container portion of the chassis, and that because of this capability to operate a toy automobile according to the present method using any of the aforementioned choices, it is very enjoyable to use.

Although the present invention has been described in its preferred embodiment with reference to the accompanying drawings, it is readily understood that various changes and modifications may be made without departing from the spirit and scope of the present invention.

What is claimed is:

1. A toy automobile having selective drive wheels, comprising:

a body;

a chassis having front and rear spaces, which is detachably mounted to the body;

a pair of front wheels which are rotatably mounted to the chassis through either a front wheel windup spring drive unit or a first freewheel holder, which is detachably arranged in the front space of the chassis; and a pair of rear wheels which are rotatably mounted to the chassis through either a rear wheel windup spring drive unit or a second freewheel holder of the same type as the first freewheel holder, which is detachably arranged in the rear space of the chassis, whereby a selection between front wheel drive, rear wheel drive, four-wheel dirve or four-freewheel is made possible.

2. A toy automobile as defined in claim 1, wherein the chassis is provided with engaging projections in the front and the rear spaces, and the front wheel windup spring drive unit, the rear wheel windup spring drive unit, and both the first freewheel holder and the second freewheel holders are provided with engaging grooves or corners, in which the engaging projections of the former are engaged with the engaging grooves or corners of the latter when the latter is arranged in the front or the rear space of the former.

3. A toy automobile as defined in claim 2, wherein the front and the rear spaces of the chassis integrally constitute a container portion, and the container portion is provided with engaging projections in the upper inner middle portions of its side walls in the front and the rear spaces.

4. A toy automobile as defined in claim 3, wherein the freewheel holder is provided with pairs of front and rear axle slits in its side walls at distances $L_1$ and $L_2$ from its front end wall, and the container portion of the chassis is provided with front and rear axle slits in its side walls at distances $L_1$ and $L_2$ from the inlets of its grooves and its rear end wall, respectively.

5. A toy automobile having selective drive wheels, comprising:

a chassis having front and rear spaces;

a pair of front wheels which are rotatably mounted to the chassis through either a front wheel windup spring drive unit or a first freewheel holder, which is detachably arranged in the front space of the chassis; and a pair of rear wheels which are rotatably mounted to the chassis through either a rear wheel windup spring drive unit or a second freewheel holder, which is detachably arranged in the rear space of the chassis, whereby a selection between front wheel drive, rear wheel drive, four-wheel drive or four-freewheel is made possible.

6. The invention of claim 5 wherein the chassis is provided with engaging projections and front rear axle slits.

7. The invention of claim 6 wherein the front wheel windup spring drive unit, the rear wheel windup spring drive unit, and the first and second freewheel holders are provided with engaging grooves or corners that engage the engaging projections.

8. The invention of claim 6 wherein the chassis is further provided with a plurality of engaging grooves and slots.

9. The invention of claim 8 wherein the front wheel windup spring drive unit, the rear wheel windup spring drive unit, and the first and second freewheel holders are provided with a plurality of projections that can interface the slots and grooves of the chassis.

10. A toy automobile comprising:

a chassis member having front and rear inner spaces;

a first driving unit including a pair of front wheels, which is capable of being detachably mounted to said front space of said chassis member;

a second driving unit including a pair of rear wheels, which is capable of being detachably mounted to said rear space of said chassis member; and wheel holder means including a pair of wheels, which is capable of being detachably mounted on either said front or rear space of said chassis member.

11. The invention of claim 10 wherein the chassis is provided with engaging projections and a plurality of slots and grooves.

12. The invention of claim 11 wherein the first driving unit, second driving unit, and the wheel holder means are provided with engaging grooves or corners that can engage the engaging projections, and further provided with a plurality of projections that can engage the slots and grooves.

13. The invention of claim 12 wherein the engaging projections are fixed on opposite sides of the chassis and disposed in both the front and rear inner spaces.

14. The invention of claim 13 wherein the slots and grooves are positioned on opposing sides of the chassis.

* * * * *